US005336143A

United States Patent [19]

Wu

[11] Patent Number: 5,336,143

[45] Date of Patent: Aug. 9, 1994

[54] MECHANISM OF A STEPPING DEVICE

[76] Inventor: Hong-Chi Wu, No. 1-2, Lane 975, Chun-Jih Road, Tao-Yuan City, Taiwan

[21] Appl. No.: 119,542

[22] Filed: Sep. 13, 1993

[51] Int. Cl.[5] ..... A63B 23/04

[52] U.S. Cl. ..... 482/52; 482/903

[58] Field of Search ..... 482/52, 53, 110, 903

[56] References Cited

U.S. PATENT DOCUMENTS 4,708,338 11/1987 Potts ..... 482/52

4,720,093 1/1988 Del Mar ..... 482/52

*Primary Examiner*—Stephen R. Crow

*Attorney, Agent, or Firm*—Morton J. Rosenberg; David I. Klein

[57] ABSTRACT

A improved mechanism of a stepping device includes a pedal mechanism constructed by a parallelogram which facilitates the pedal remains at a horizontal position at all levels. A trasnaxle is rotated as the pedal is stepped down and a gear and an actuating gear are used to connect a load adjusting device. Then a predetermined load can be applied to the pedal as it moves down. A one-way bearing is disposed inside the bushing of the transaxle, hence the pulley disposed thereof can rotate bi-directionally. A pulling rope and a spring are used to pull up the pedal which moves to a lower dead point. While the inertia of the gear and actuating wheel will make it moves continuously. By this arrangement, a smooth and continuous stepping device is provided.

2 Claims, 5 Drawing Sheets

MECHANISM OF A STEPPING DEVICE

BACKGROUND OF THE INVENTION

This invention relates to an improved stepping device mechanism. Particularly, the mechanism relates to a stepping device used indoors.

Existing stepping devices may either be of simple construction or classified as deluxe dependent upon the options provided. For simplified stepping machines, pedals of the stepping device are supported by either a hydraulic cylinder or a coil spring. In this manner, the pedal may be alternatively moved upwardly and downwardly. Simple constructed systems do not provide any adjustment for adjusting stepping loads, hence, the stepping load in such simplified devices is linear. In the deluxe, complex stepping device such are equipped with an adjustment for stepping loads. By this arrangement, the stepping load may be adjusted directly on a control panel and selecting a suitable stepping load is allowed in accordance with individual requirements. Among these conventional adjusting devices, the electromagnetic load adjuster is generally the most accurate. U.S. Pat. No. #5,096,024 entitled "Adjustable Magnetic Brake" has been widely used in such devices. The rotating direction of such a braking device is limited to one direction and a mechanism must be incorporated for a sporting device which allows a reciprocal movement. In general, the mechanism used for a conventional stepping device is complicated and includes a large volume. Additionally, set up time is increased for prior art systems and movements are not continuous and smooth.

SUMMARY OF THE INVENTION

It is the object of this invention to provide an improvement on a mechanism of a stepping device to alleviate disadvantages of prior art exercising stepping devices.

In order to achieve the objectives as herein set forth, the mechanism provided according to this invention includes a transversely directed axle which is rotated by a pedal as it reciprocally is displaced downwardly and upwardly. A gear is disposed at a central position of the transversely directed axle. The gear is connected to a loading device through an idle gear meshed therebetween. By this arrangement, the loading device can provide a substantial load to the stepper.

The mechanism provided according to this invention further includes a set of parallelogram linkages to the pedal which keeps the pedal horizontal as the pedal is displaced upwardly and downwardly which allows the user to step smoothly and in a normal manner.

The mechanism provided according to this invention further includes a one-way bearing disposed on both sides of the transversely directed axle facilitating a smooth and normal movement to the pedal in combination with the inertia generated by the gear.

DESCRIPTION OF THE PREFERRED EMBODIMENT

Referring now to FIGS. 1-5, there is shown an improved stepping mechanism including a frame 1, a supporting bar 11, a control panel 12 and a handrail 13 with the control panel 12 mounted on the handrail 13 as shown.

Figure 1:
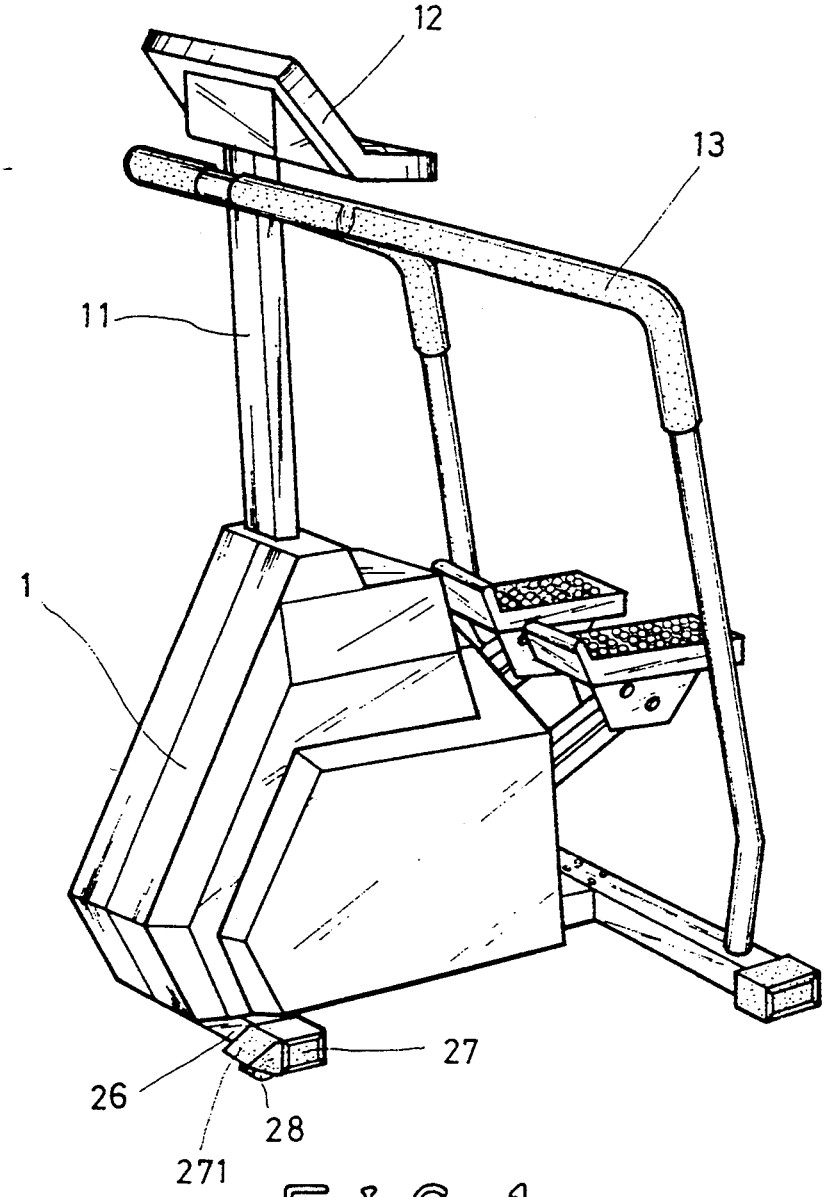
FIG. 1 is a perspective view of an embodiment of an improved mechanism made according to the subject invention concept.
Figure 2:
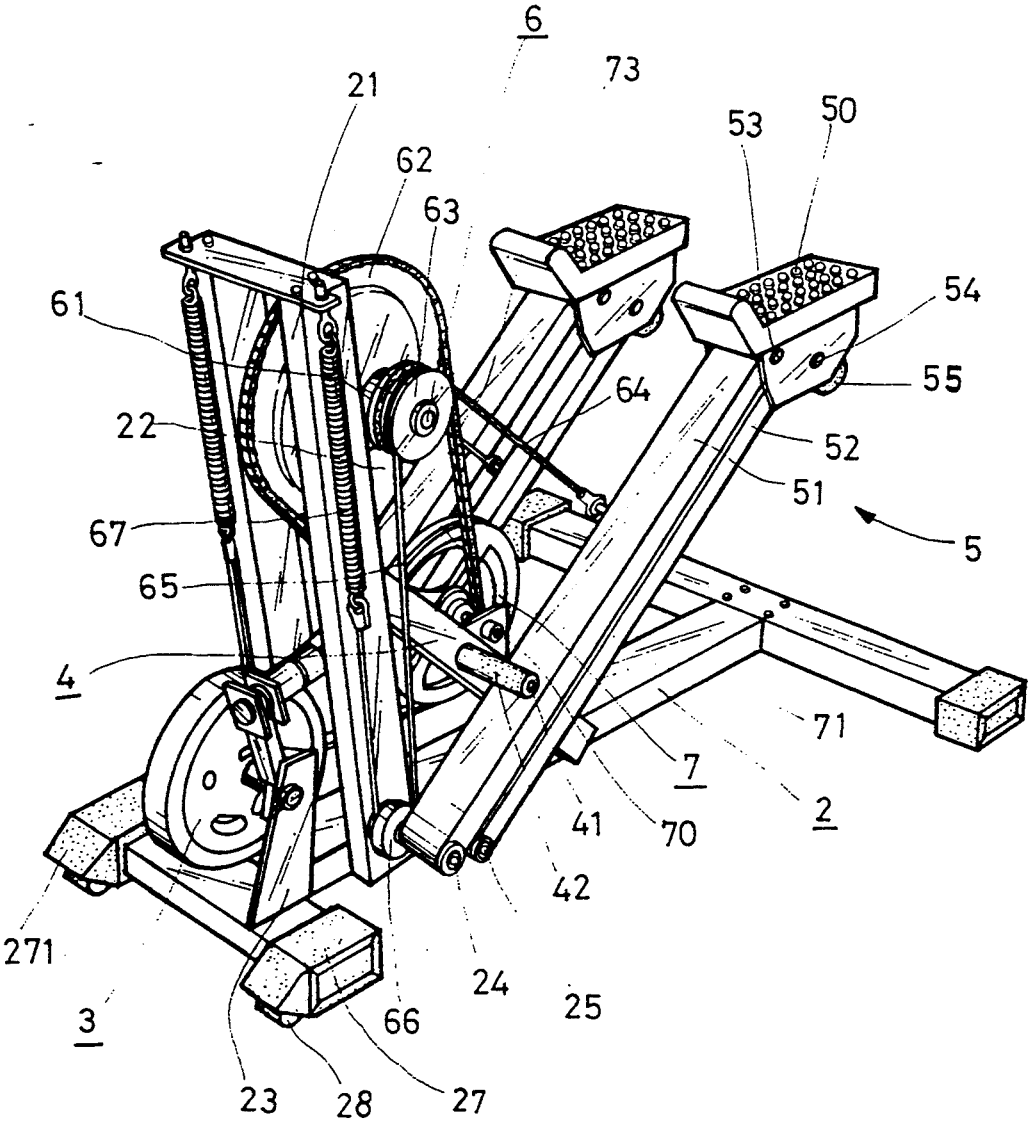
FIG. 2 is a perspective view of the mechanism incorporated in the stepping device.
Figure 3:
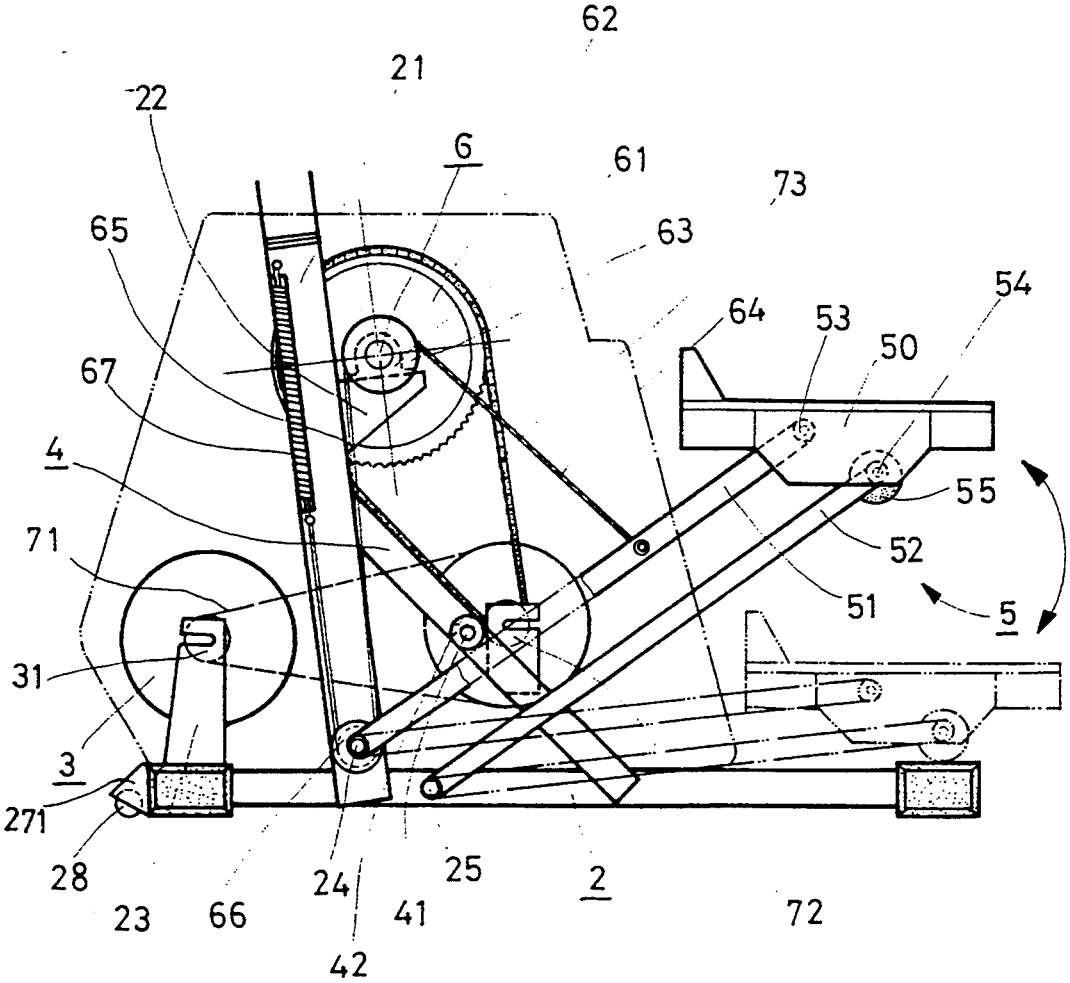
FIG. 3 is a side elevational view of the mechanism incorporated in the stepping device.
Figure 4:
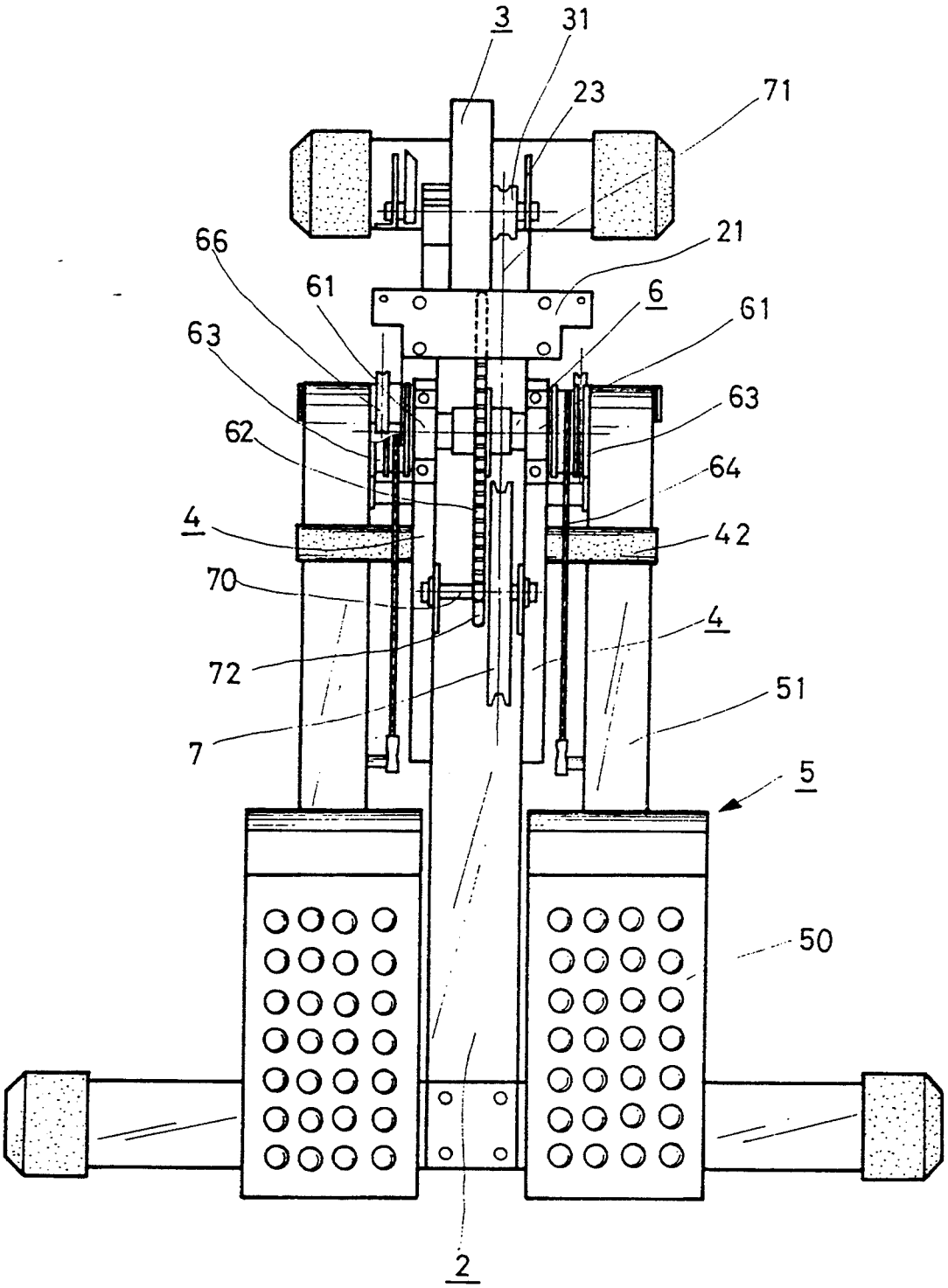
FIG. 4 is a top view of the mechanism incorporated in the stepping device.

An H-type bottom truss 2 having a pair of longitudinally displaced and transversely directed truss leg members as well as a central truss leg member is shown in FIGS. 1, 2 and 4. Two parallel supporting beams 21 are mounted on opposing sides of the central truss leg member. The supporting beams 21 have a triangle plate 22 attached respectively. A plastic pocket 27 is formed in the opposing ends of a transversely directed truss leg member. A cover 271 is disposed at the front of the pocket 27 and a caster 28 is mounted thereon.

A load adjusting device 3 is located between the rear portion of the supporting beam 2 and a supporting plate 23. As shown in FIG. 4, a rotating wheel 31 is mounted on one side of load adjusting device 3. Since the load adjusting device 3 has been disclosed in U.S. Pat. No. #5,096,024, no further detailed description is deemed necessary.

A pair of auxiliary plates 4 extend from the bottom truss 2 to the front portion of each supporting beam 21. A positioning lever 41 is installed and extends from each supporting beam 21. An elastomer 42 covers the peripheral area of each positioning lever 41.

The groups of pedals 5 form a linkage constructed by an upper plate 51 and a lower plate 52 which are maintained parallel to each other. The head portion forms a leg base 50. Two supporting levers 53, 54 pass through the leg base 50 for positioning. A spring 55 is secured to the lower shaft 54 and spring 55 extends beyond the leg base 50. The lower end of the upper plate 51 is fixed to a small shaft 24 of the supporting beam 21 and the lower end of the lower plate 52 is rotatably fixed to a shaft member 25 of the bottom truss 2. The upper plate 51 and lower plate 52 are reciprocally moved upwardly and downwardly in rotative displacement about the shaft members 24, 25.

Figure 5:
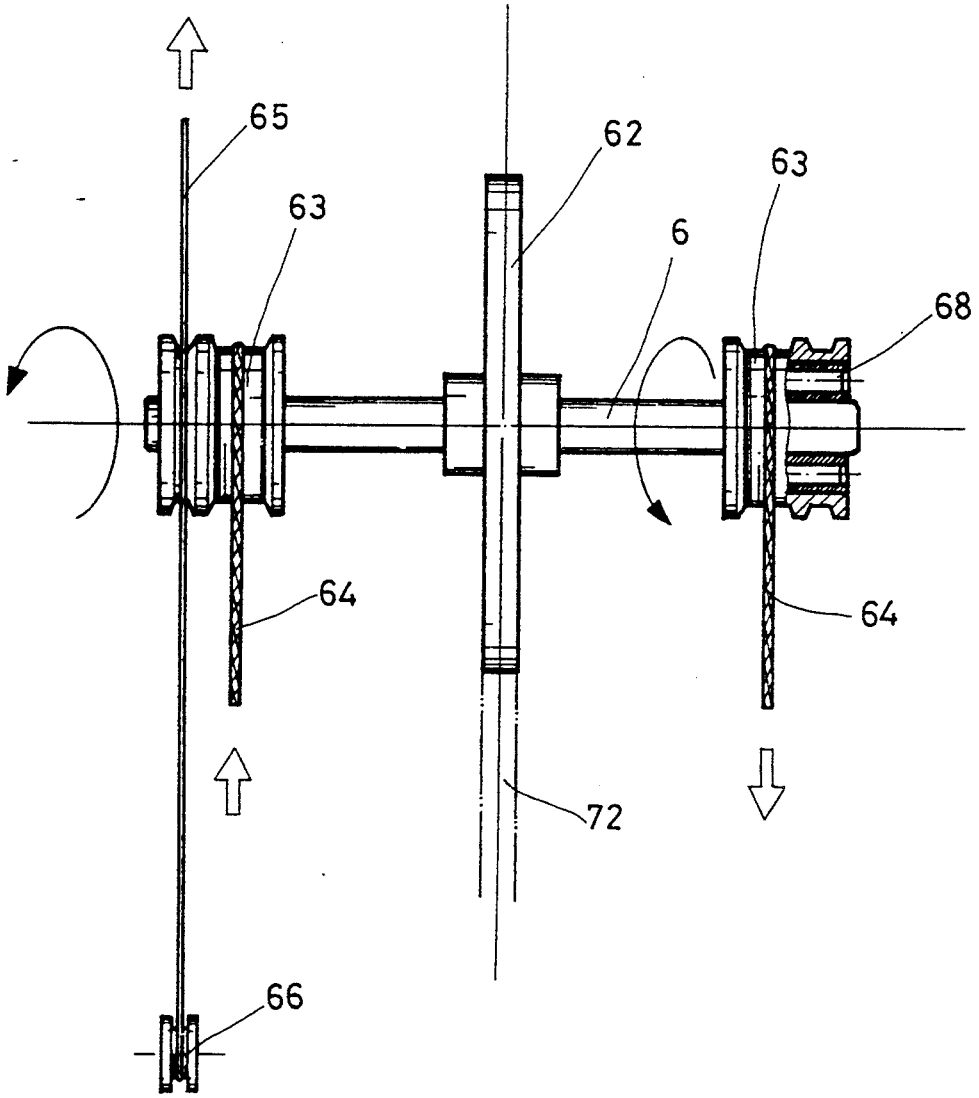
FIG. 5 is a plan view of moving parts of the mechanism incorporated in the stepping device.

A transversely directed axle 6 is fixed to the triangular plate 22 fixed to the supporting beam 21 through bushing 61. A central gear 62 is located at the middle portion of transversely directed axle 6. A pulley 63 is formed at the sides of the transversely directed axle 6. A first actuating rope 64 is wound on an inner slot of the pulley 63. The other end of the first actuating rope 64 is secured to the upper plate 51. The outer slot of the pulley 63 has wound thereon a second actuating rope 65. After the second actuating rope 65 passes over the pulley 66 of the upper plate 51, the second actuating rope 65 is fixed to a spring 67 of the supporting beam 21. A one-way-bearing 68 is disposed between the pulley 63 and the transversely directed axle 6, as shown in FIG. 5.

An actuating wheel 7 is mounted on a shaft 70 which is supported by two auxiliary plates 4. Actuating wheel 71 is connected with the load adjusting device 3 by a belt member 71. A small gear is mounted on the shaft 70 and is connected to the gear 62 through a chain 72.

By this arrangement, the stepping device made according to this invention provides a smoother and normal movement of the leg. Additionally, throughout all stepping movements, the pedals are kept horizontal at all levels.

The detailed description of the movement of the stepping device is provided as follows:

1. The pedals 5 according to this invention move alternatively upwardly and downwardly. The downward moving pedal 5 receives the load provided by the load adjusting device 3 and this pedal 5 moves upwardly by a force which is inertia free from load, meaning the leg withstands no force. The upper plate 51 and the lower plate 52 are centered by the shaft members 24, 25 and the shaft members 53, 54 of the lower plate 52 jointly form a parallelogram linkage. In this manner, the base of the pedal 5 is kept horizontal throughout displacement. This feature provides a smooth and normal step motion for the user. The problems encountered by the conventional stepping device are solved by the subject stepping device.

2. As the pedal 5 moves downwardly, the rope 64 makes the pulley 63 and transversely directed axle 6 rotate in a preset direction. The centrally mounted gear 52 at the middle of the transversely directed axle 6 is connected to the small gear 72 of the actuating wheel 7 through a chain 73. As a result of this coupling, the small gear is moved in its preset direction. The actuating wheel 7 has a load applied from the load adjusting device 3 which is transmitted to the transversely directed axle 6 and pulley 63. By this arrangement, the pedal 5 will move downward having a preset load applied and moves downwardly in a slow and controlled manner. The pedal 5 lowers to the bottom truss 2 through the elastomer 55 disposed within the leg base 50. As the pedal 5 moves to its dead point of its lowering stroke, the leg applies no force to the pedal 5, hence the rope 64 which is wound on the pulley 63 will be released therefrom by a force applied by spring 67. This will make the pulley 63 rotate counterclockwise and the actuating rope 64 will pull the pedal 5 from its dead point. The pedal 5 is stopped by the elastomer 42 of the positioning lever 41 and the released actuating rope 64 is wound on the inner slot of the pulley 63. As the pulley 5 is moved downwardly again, the pulley 63 will be displaced. Meanwhile, the transversely directed axle 6 is rotated by the inertia of the gear 62 which provides a smooth and continuous movement.

3. As illustrated in FIGS. 4 and 5, the transversely directed axle 6 and the gear 62 is rotated in one direction to accompany the rotation of the load adjusting device 3 which is limited to rotate in one direction. However, the pulley 63 must be rotated in two directions and pull up the pedal 5 from the lower dead point. Hence, a one-way bearing 68 is installed between the pulley 63 and transversely directed axle 6. As the pedal 5 moves downwardly, the pulley 63 will be actuated to rotate the transversely directed axle 6 as the pedal 5 is moved up and the pulley will idle. By the rope 65 and the force of the spring 67, the pulley 63 will idle and pull up the pedal 5. In light of this, as the user steps on the leg base 50 of the pedal 5, only one leg applies force to the pedal 5 and the other leg provides no force. As one leg forces down a pedal 5, the other leg is lifted up by the other pedal 5.

4. A caster 28 is disposed within the cover 271 located at the front of the plastic pocket 27 of the transverse beam 26. As the user moves the stepping machine, he or she only needs to lift up the rear end to force the caster 28 into contact with the ground. With this accomplished, the stepping machine can be moved easily.

It will be readily appreciated by those skilled in the art that this stepping device provides an effective and convenient means for indoor exercise. The above disclosed embodiment is only for illustration and not for limitation. Any modification or alternative pertinent to this invention may be easily accomplished by those skilled in the art and will fall under the scope of the appended claims.

I claim:

1. An exercise stepping device comprising:

(a) a frame including a vertically extending support bar member, a handrail, and a control panel mounted on said support bar member;

(b) a bottom truss being H-shaped in contour defining a pair of longitudinally displaced and transversely directed truss leg members and a longitudinally directed central truss leg member, said central truss leg member having a pair of support beam members secured thereto on opposing transverse sides thereof and extending in a substantially vertical direction, said support beam having a triangularly contoured plate member secured thereto;

(c) load adjustment means for selectively providing a predetermined resistance force, said load adjustment means being rotatably mounted between said support beam members to a rear one of said longitudinally displaced truss leg members by at least one supporting plate member, said load adjustment means having a rotating wheel member;

(d) a pair of auxiliary plate members rotatably mounted to respective support beam members which extend adjacent said bottom truss, each of said auxiliary plate members having a positioning lever member extending in a transverse direction;

(e) pedal means for being reciprocally displaced, said pedal means including a pair of pedal upper plate members and pair of pedal lower plate members, each of said pedal upper and lower plate members being displaced parallel each to the other, each of said pedal upper plate members being rotatably mounted to a respective support beam at a lower end thereof, each of said pedal lower plate members being rotatably mounted to respective opposing sides of said longitudinally central truss leg members at a lower end thereof, said pedal upper plate members and said pedal lower plate members having respective upper ends thereof rotatably mounted to respective pedal leg base members having respective spring members extending from a lower surface of said pedal by base members, each of said pedal upper and lower plate members in coupled relation to a respective support beam and pedal leg base member forming a parallelogram linkage;

(f) a transversely directed axle rotatably mounted to said triangular plate member, said transversely directed axle having a central axis gear mounted thereon, and a pair of axle pulley members mounted to said transversely directed axle on opposing transverse ends, each of said axle pulley members being coupled to said axle by a one-way rotational bearing, each of said axle pulley members having an inner and an outer slot, a pair of first actuating ropes respectively wound on a respective pulley inner slot on one end and secured to a respective pedal upper plate member at an opposing end, a pair of second actuating ropes respectively wound on a respective pulley outer slot on one end thereof and secured to a support beam spring on a second opposing end thereof; and, (f) an actuating wheel rotatively coupled to said load adjustment means and said central axis gear.

2. The exercise stepping device as recited in claim 1 where at least one of said transversely directed truss leg members includes a pair of plastic pocket cover members mounted on opposing transverse ends thereof and having respective casters extending therefrom.

* * * * *